United States Patent [19]

Faye et al.

[11] Patent Number: 4,596,949

[45] Date of Patent: Jun. 24, 1986

[54] DEVICE FOR VARYING AN ELECTRODE VOLTAGE FOR A CATHODE-RAY TUBE

[75] Inventors: Francis Faye, La Celle Saint Cloud; Georges Prigent, Versailles, both of France

[73] Assignee: U.S. Philips Corporation, New York, N.Y.

[21] Appl. No.: 667,041

[22] Filed: Nov. 1, 1984

[30] Foreign Application Priority Data

Nov. 7, 1983 [FR] France ..... 83 17650
May 22, 1984 [FR] France ..... 84 07954

[51] Int. Cl.[4] ..... H01F 40/04

[52] U.S. Cl. ..... 323/359; 336/192; 338/176

[58] Field of Search ..... 323/264, 347, 353, 355, 323/359; 338/73, 74, 87, 117, 118, 160, 202, 216, 220, 229, 331, 333, 176; 336/192; 358/190

[56] References Cited

U.S. PATENT DOCUMENTS 4,271,463 6/1981 Tanimura et al. ..... 336/192

FOREIGN PATENT DOCUMENTS 2830957 1/1980 Fed. Rep. of Germany ..... 323/355

*Primary Examiner*—Peter S. Wong
*Assistant Examiner*—Judson H. Jones
*Attorney, Agent, or Firm*—Robert T. Mayer; Bernard Franzblau

[57] ABSTRACT

A device for varying an electrode voltage of a CRT of a color TV includes a novel potentiometer arrangement for adjusting the aforesaid electrode voltage. In known voltage-generating devices the electrode voltage is adjusted by a special potentiometer which can handle several kilovolts. According to the invention, the potentiometer track is constituted by a resistive layer (2) situated inside the interior of the output-voltage feedthrough (10) and the wiper is constituted by the end portion of the high-voltage cable (9) which is inserted into a tubular feedthrough portion and which can slide therein in order to adjust the voltage.

15 Claims, 19 Drawing Figures

DEVICE FOR VARYING AN ELECTRODE VOLTAGE FOR A CATHODE-RAY TUBE

BACKGROUND OF THE INVENTION

This invention relates to a device for generating a variable voltage for energizing at least one electrode of a cathode-ray tube, which device comprises a transformer having a winding for supplying at least one voltage and at least one tubular portion into which at least one electrical cable is inserted and in which said cable is brought into contact with the winding.

The invention is mainly used in colour television receivers.

In known voltage-generating devices the voltage is varied by means of a special potentiometer which can handle a voltage of several kilovolts across its terminals. Such a potentiometer can be found in, for example, the Philips catalogue under the name "Focus Potentiometer Unit".

Such a potentiometer is bulky, difficult to connect and, in particular, expensive to manufacture because of the insulation requirements imposed by the presence of high voltages.

SUMMARY OF THE INVENTION

It is an object of the invention to dispense with such a component so that it is not necessary to connect this component to the transformer and to the voltage-generating element.

The voltage-generating devices comprise a transformer having a winding for supplying a voltage and a tubular portion into which an electrical cable is inserted and in which the cable is brought into contact with the winding.

The device in accordance with the invention is characterized in that inside said tubular portion there is arranged at least one resistive layer having one end connected to a point on the winding. The electrical cable is provided with means for establishing contact with said layer and the insertion depth of the cable in the tubular portion is adjustable.

In the device in accordance with the invention the track of the potentiometer is constituted by a resistive layer arranged in the interior of the tubular portion for the focussing-voltage output and the wiper of the potentiometer is constituted by the end portion of the high-voltage cable insertable in said tubular portion, said end portion being slidable in said tubular portion in order to vary the voltage.

In order to avoid the use of an additional resistor the other end of the resistive layer is preferably connected to another point on the winding.

Suitably, the means for establishing contact with the layer comprise the end portion of the conductor of the cable, folded back onto its insulating sheath.

The device in accordance with the invention enables a variable high-voltage to be applied by very simple and cheap means.

Moreover, the device in accordance with the invention may be used for applying both the focussing voltage and the bias voltage for the second grid of the cathode-ray tube, for which purpose the tubular portion has two recesses each of which receives one cable, which recesses are each provided with a resistive layer.

BRIEF DESCRIPTION OF THE DRAWING

The invention will now be described in more detail, by way of example, with reference to the accompanying drawings in which.

DESCRIPTION OF THE PREFERRED EMBODIMENT

Figure 1A:
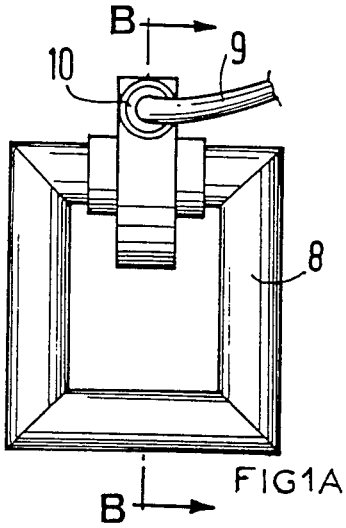
FIGS. 1A and 1B show a transformer used in the device in accordance with the invention in side view and in sectional view, respectively.
Figure 1B:
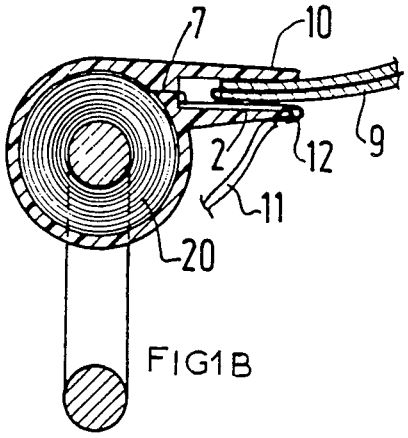

FIG. 1 shows a high-voltage transformer for a television set. In the customary manner this transformer comprises a plurality of coils or windings which supply the various voltages, which windings are arranged around a ferrite core 8. The winding 20 which is shown supplies the focussing voltage. The transformer comprises a projecting tubular portion 10 into which an electrical cable 9 is inserted so that this cable is brought into contact with the winding 20.

Inside this tubular portion 10 there is arranged a resistive layer 2 having one end connected to a point on the winding via the connection 7. The electrical cable 9 has been provided with means for establishing contact with said layer and its insertion depth in the tubular portion is adjustable by hand or by any easy-to-realize mechanical means.

Figures 2A, 2B:
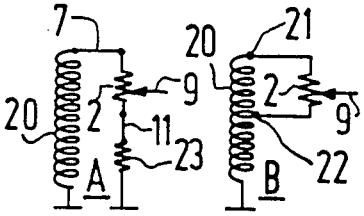
FIGS. 2A and 2B are two electrical diagrams showing the connections to the winding.

The other end of the resistive layer 2 is connected to a conductor 11, for example by means of a clip 12. FIG. 2A, in which the winding 20 and the resistive layer 2 are also shown shows that via the conductor 11 said other end is connected to a fixed resistor 23 which is connected to ground.

This is the customary arrangement. Further, the arrangement comprises rectifier diodes, not shown, which may be arranged in different ways as described in, for example, the publication "Le nouveau guide de la télévision en couleurs" published by Editions Chiron of Paris, pages 229 to 240. Generally, these diodes are incorporated in the encapsulation of the winding, for example, as described in French Patent Specification 2,146,419. Thus, one diode may be arranged in series in the connection 7.

The diagram of FIG. 2B shows another method of connecting the potentiometer. This possibility has not been used in the prior art because it requires the presence of a second tubular portion for connecting the other end of the potentiometer to point 22. However, in the scope of the present invention this arrangement is advantageous because it enables the conductor 11 and the resistor 23 to be dispensed with. The two ends of the resistive layer, situated in the same tubular portion 10, are connected to the points 21 and 22 of the winding.

Figure 3A:
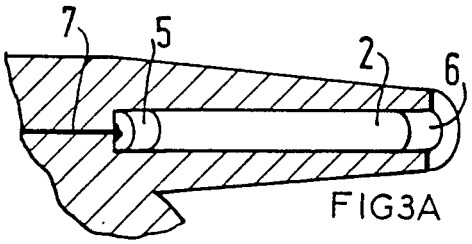
FIGS. 3A and 3B are partly sectional views of two examples of the tubular portion used in the device in accordance with the invention.

The tubular portion shown in FIG. 3A comprises a resistive layer 2 which has been deposited directly inside this tubular portion. This may be effected by means of a plasma-deposition technique. This well-known technique enables inaccessible surfaces to be metallized. On the two end portions 5, 6 a conductive layer is deposited, the central portion of the layer 2 being masked during deposition. The conductive portions 5, 6 serve for connection to the connection point 7 and the clip 12, respectively.

Figure 3B:
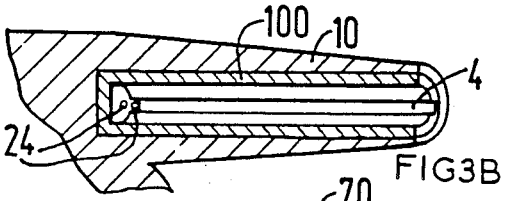

The insulator in FIG. 3B has been provided with a preformed insert 100. This insert comprises a groove 4 in which an insulating strip coated with a resistive layer has been fitted.

Figure 4:
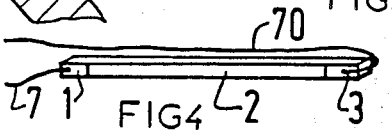
FIG. 4 shows an insulating strip covered with a resistive layer.

FIG. 4 shows such a strip with a resistive layer 2 on one side, each of the ends being provided with a conductive layer 1, 3. These layers are preferably deposited by thick-film silk-screening on a ceramic substrate which comprises a large number of strips which are subsequently severed to form separate strips. To the end layers 1 and 3 connections 7 and 70 are made, the connection 70, for example, being folded back behind the strip. Subsequently, the strip is mounted in the insert 100, the connections 7, 70 being passed through holes 24, after which the connections 7, 70 are connected to the winding 20 and, finally, the assembly comprising the winding and the insert 100 is moulded-in to form a block comprising the tubular portion 10.

Figure 5A:
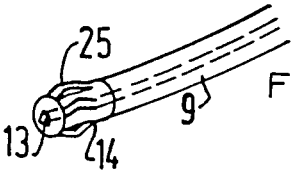
FIGS. 5A and 5b are perspective views of the means for establishing contact between the cable and the resistive layer.
Figure 5B:
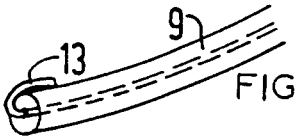

The end portion of the cable 9 in FIG. 5A has been provided with a ferrule 14 which has been soldered onto the central conductor 13 of the cable. This ferrule comprises one or more cut-out portions which each constitute an elastic strip 25 which ensures a satisfactory contact with the resistive layer. In a simplified version shown in FIG. 5B, the end of the rigid central conductor 13 of the cable is folded back onto its insulating sheath in order to establish contact with the resistive layer. This arrangement is intended for use in combination with the tubular portion shown in FIG. 3B, in which the depth of the groove 4 is larger than the thickness of the strip in such a way that after this strip has been secured to the back of the groove the resistive layer remains clear of the inner wall of the tubular portion, so that a groove is left which receives the end 13 of the cable to establish contact with the strip, thereby preventing the cable from being rotated about its axis. Instead of mounting a narrow strip in the groove, it is possible to use a comparatively wide strip accomodated in a recess formed adjacent the recess intended for insertion of the cable, a slot being formed between said recesses to allow the passage of the conductive end portion of the cable. Such an arrangement is shown and will be described with reference to FIGS. 7A, B, C.

Figure 7A:
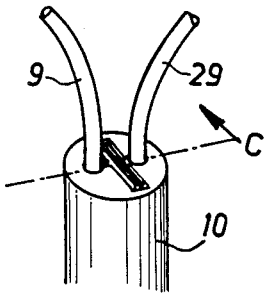
FIGS. 7A to 7C illustrate a special embodiment of the invention in which the tubular portion has two recesses show in perspective view, in cross-sectional view and in longitudinal sectional view, respectively.

For applying the focussing voltage and the voltage for the second grid of a cathode-ray tube of a colour television set the tubular portion shown in FIG. 7A has two recesses, for a cable 9 and 29, respectively, which recesses have each been provided with a resistive layer.

Figure 9:
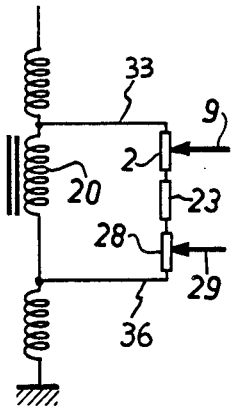
FIG. 9 is a connection diagram for two electrode of a cathode-ray tube.

By means of this arrangement the electrical circuit shown in FIG. 9 can be realized. The winding 20 supplies a voltage of approximately 8 kV, a conductor 33 taking this voltage to one end of a resistive track 2 which is in contact with the cable 9 which leads to the focussing electrode. This track is followed by a track constituting the fixed resistor 23 and a resistive track 28 which is in contact with the cable 29 which leads to the second grid of the cathode-ray tube. The end of the track 28 which is remote from the track 23 is connected to a terminal of the transformer winding by a conductor 36, which terminal supplies approximately 0.5 kV. Alternatively, it may be connected to ground via a fixed resistor.

Figure 7B:
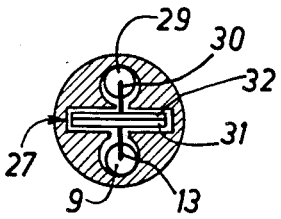

FIG. 7B is a cross-sectional view of the tubular portion shown in FIG. 7A. It shows two cables 9, 29 in two cylindrical recesses and two strips 31, 32 with which the respective ends 13, 20 of the cables 9, 29 are in contact. The strips 31, 32 are together arranged in a suitable recess formed between the two cable recesses and these cable recesses communicate with the recess 27 via openings which extend parallel to the cable axes to allow the passage of the end portions of the cables 13, 30. It is obvious that a ferrule similar to that shown in FIG. 5A may be used.

Figure 7C:
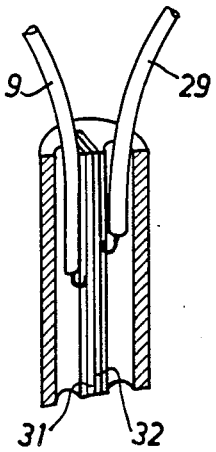

FIG. 7C, which is a perspective view, partly sectional view taken on the line C in FIG. 7A, illustrates how the cables 9, 29 and the strips 31, 32 are arranged.

Figure 8A:
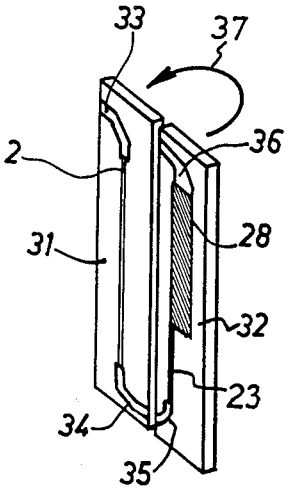
FIGS. 8A and 8B show strips provided with resistive layers in different stages of manufacture.

FIG. 8A shows the strips 31 and 32 viewed at the sides which carry the resistive tracks 2 and 28 and the conductor tracks 33 to 36 interconnecting them. The strips have been cut from an aluminum sheet and the tracks have been formed by means of a "thick-film" technique by silk-screening and curing.

The track 28 is wider than the track 2 because for a specific displacement of the cable the former track should produce a variation of approximately 400 V and the track 2 should provide a variation of approximately 2 kV. The extension of the track 28 which constitutes the resistor 23 is laterally offset in order to ensure that in the case of an inadequate insertion of the cable this cable is no longer in contact with the resistor thereby to prevent an excessively high voltage from being applied to the second grid.

Figure 8B:
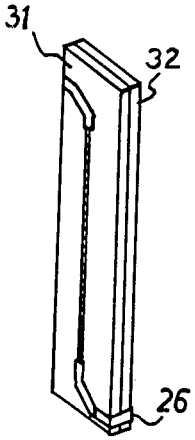

Before it is fitted into the tubular portion 10 the strip 32 is placed back-to-back against the plate 31 as indicated by the arrow 37, so that the strip assembly shown in FIG. 8B is obtained. A clip 26 provides the electrical connection between the conductive tracks 34 and 35 in FIG. 8A and the tracks 33 and 36 are connected to terminals of the winding as described above with reference to FIG. 9.

Figure 6A:
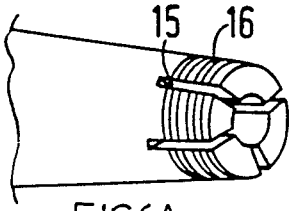
FIGS. 6A, 6B, 6C and 6D illustrate different examples of cable locking means.
Figure 6B:
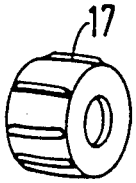
Figure 6C:
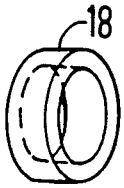
Figure 6D:
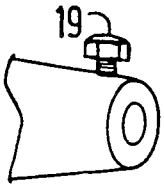

FIG. 6A shows the external end portion of a tubular portion with slots 15 around the cable recess. The slots 15 enable the cable to be locked in position by clamping. This is effected by, for example, a ring 17 as shown in FIG. 6B, which ring is screwed onto the screwthread 16 of the tubular portion until clamping is achieved. Alternatively, a ring 18 shown in FIG. 6C may be forced onto the frustoconical end portion of the tubular portion. Moreover, the cable may be fixed by means of a locking screw 19 as shown in FIG. 6D. Although FIGS. 6A and 6D show a tubular portion for one cable, it will be appreciated that the means described with reference to these Figures, and in particular FIG. 6D, may also be employed in the case of a tubular portion for two cables.

Other methods of forming the resistive layer, of constructing the contacting means or locking the cable are conceivable without departing from the scope of the invention. For example, for locking the cable or cables a wedge-like member may be inserted between the two cables until they are locked, or between a cable and a stop on the outside of the tubular portion. Also, a part of the conductive track 36 (FIG. 8A) may be replaced by a resistive track which constitutes the fixed resistor.

What is claimed is:

1. A device for generating a variable voltage for energizing at least one electrode of a cathode-ray tube comprising: a transformer having a winding for supplying at least one voltage, at least one tubular portion containing at least one electrical cable in contact with the winding, at least one resistive layer arranged inside said tubular portion and having one end connected to a point on the winding, and wherein the electrical cable is provided with means for establishing contact with said layer and the insertion depth of the cable in the tubular portion is adjustable.

2. A device as claimed in claim 1, characterized in that the means for establishing contact with the layer comprise the end portion of the conductor of the cable, folded back onto its insulating sheath.

3. A device as claimed in claim 1, wherein the means for establishing contact with the layer comprise a ferrule including at least one elastic strip.

4. A device as claimed in any claim 1 wherein the resistive layer is situated in a groove in a wall of the tubular portion.

5. A device as claimed in claim 1 wherein the other end of the resistive layer is connected to another point on the winding.

6. A device as claimed in claim 1 further comprising an insulating strip provided with a resistive layer situated in said tubular portion.

7. A device as claimed in claim 1 wherein the resistive layer is deposited directly on the inner wall of the tubular portion.

8. A device as claimed in claim 1, characterized in that the tubular portion has two recesses for one cable each, which recesses each have a resistive layer, for applying the focussing voltage and the voltage for the second grid of the cathode-ray tube, respectively.

9. A device as claimed in claim 1 wherein the tubular portion has two recesses for receiving one cable each, which recesses are each provided with an insulating strip carrying a resistive layer with said strips arranged back-to-back between the two recesses, their resistive layers being connected in series.

10. A device as claimed in claim 1 further comprising cable-locking means.

11. A device as claimed in claim 2 wherein the resistive layer is located within a groove in a wall of the tubular portion.

12. A device as claimed in claim 2 wherein the other end of the resistive layer is connected to another point on the winding.

13. A device as claimed in claim 4 wherein the other end of the resistive layer is connected to another point on the winding.

14. A device as claimed in claim 2 further comprising an insulating strip provided with a resistive layer and located within said tubular portion.

15. A device as claimed in claim 4 wherein the resistive layer is deposited directly on an inner wall of the tubular portion.

* * * * *